US005170001A

United States Patent [19]

Amendola

[11] Patent Number: 5,170,001

[45] Date of Patent: Dec. 8, 1992

[54] DRUM STICK

[76] Inventor: William M. Amendola, 825 48th St., Brooklyn, N.Y. 11220

[21] Appl. No.: 714,924

[22] Filed: Jun. 13, 1991

[51] Int. Cl.[5] ..... G10D 13/00
[52] U.S. Cl. ..... 84/422.4
[58] Field of Search ..... 84/422.4

[56] References Cited

U.S. PATENT DOCUMENTS

| | | | |
|---|---|---|---|
| 3,165,964 | 1/1965 | Stys | 84/422.4 |
| 3,866,508 | 2/1975 | Huslig | 84/422.4 |
| 3,893,364 | 7/1985 | Harrison | 84/422.4 |
| 4,557,176 | 12/1985 | Boturla | 84/422.4 |

OTHER PUBLICATIONS

"Thanksgiving Drumsticks", by Bob Saydlowski in Gig Magazine, 1990.
"Regal Tip Whiskers and Splitstix", by Rick Mattingly, Modern Drummer, May 1991, pp. 40–44.
Advertising Brochure, Calato USA, 1990.
Advertising Brochure, American Classics.

*Primary Examiner*—Michael L. Gellner
*Assistant Examiner*—Cassandra C. Spyrou
*Attorney, Agent, or Firm*—R. Neil Sudol; Henry D. Coleman

[57] ABSTRACT

A drum stick comprises a handle portion and a substantially planar drum contact portion connected to the handle portion. The handle portion may be planar or cylindrical, substantially rectangular or tapered. In either case, the handle portion is continuous with the drum contact end of the stick.

20 Claims, 3 Drawing Sheets

DRUM STICK

BACKGROUND OF THE INVENTION

This invention relates to a musical instrument accessory, particularly a stick for playing drums.

Drum sticks have a generally cylindrical geometry with varying degrees of taper. A drum stick typically has a bead or ball at its distal end. The bead or ball is normally used to strike a tympanic surface or other part of a drum. However, any part of the drum stick may be used to elicit percussive sound from a drum or other object.

OBJECTS OF THE INVENTION

An object of the present invention is to provide a new drum stick.

Another object of the present invention is to provide such a drum stick which elicits a different kind of percussive sound from drums and other percussive instruments.

Another, more particular, object of the present invention is to provide such a drum stick which is easy to manufacture.

A further particular object of the present invention is to provide such a drum stick which is more readily usable than conventional drum sticks in a pair held by the same hand.

SUMMARY OF THE INVENTION

A drum stick comprises, in accordance with the present invention, a handle portion and a substantially planar drum contact portion connected to the handle portion.

Pursuant to a first embodiment of the present invention, the handle portion is planar and continuous with the drum contact portion. Pursuant to a second embodiment of the present invention, the handle portion is substantially cylindrical and continuous with the drum contact portion.

Preferably, the drum contact portion has a substantially semicircular distal end provided with a rounded edge.

Pursuant to another feature of the present invention, the drum contact portion is integral with the handle portion.

Pursuant to another feature of the present invention, the drum contact portion has rounded longitudinally extending edges.

Pursuant to an additional feature of the present invention, the drum contact portion is tapered from the handle portion towards a distal end of the drum stick.

A drum stick in accordance with the present invention elicits from drums and other percussive instruments a kind of percussive sound which is different from the sound elicited by conventional drum sticks. More particularly, because the drum stick is flat at its striking end and a greater area of the drum stick comes into contact with the struck surface, a flap type sound results. The difference in sound quality permits new and varied uses of drum percussive sounds in musical recordings.

A drum stick in accordance with the present is easy to manufacture. In addition, where the drum stick is totally flat or planar, a pair of sticks may be easily held against one another in the same hand, thereby resulting in a greater facility of playing drums with multiple sticks.

DETAILED DESCRIPTION

Figure 1:
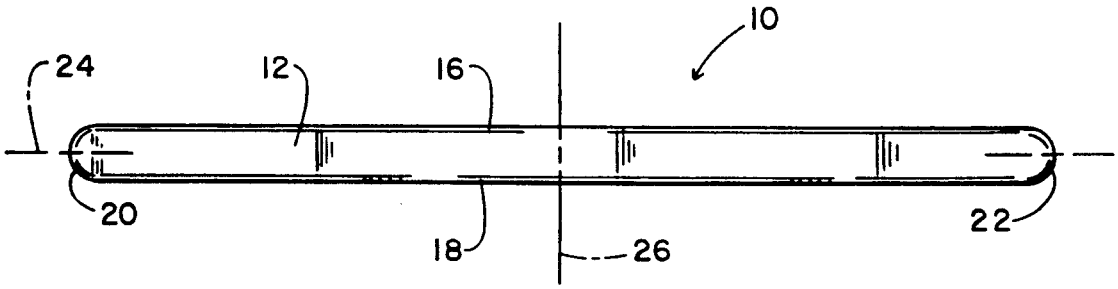
FIG. 1 is a top plan view, on a reduced scale, of a drum stick in accordance with the present invention.

As illustrated in FIGS. 1–4, a drum stick 10 comprises an integral body defined by a pair of elongate planar surfaces 12 and 14 which are joined to one another by a pair of parallel, longitudinally extending, rounded sides or edges 16 and 18. Each planar surface 12 and 14 is bounded at opposite ends by a pair of semicircular arcs 20 and 22 each being rounded to join planar surfaces 12 and 14.

The drum stick of FIGS. 1–4 is symmetrical about both a longitudinal axis 24 and a central transverse axis 26. Because of this symmetry, either end of the stick serves as the proximal or handle portion, while the other end serves as the distal, drum striking or drum contact portion.

Figure 2:
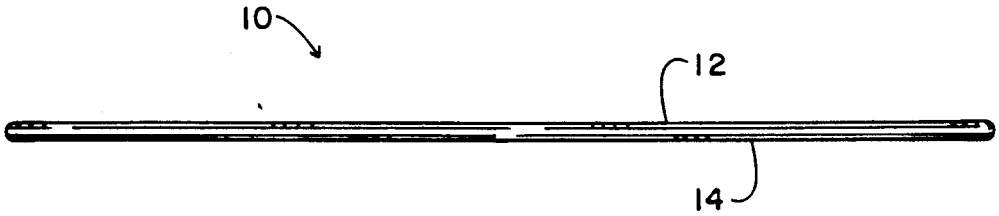
FIG. 2 is a side elevational view, on the scale of FIG. 1, of the drum stick of FIG. 1.
Figure 3:
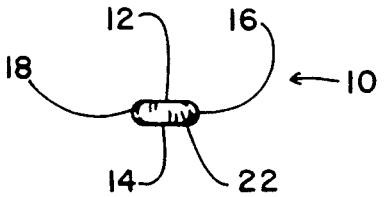
FIG. 3 is a front elevational view, essentially on the scale of FIGS. 1 and 2, of the drum stick of those drawing figures.
Figure 4:
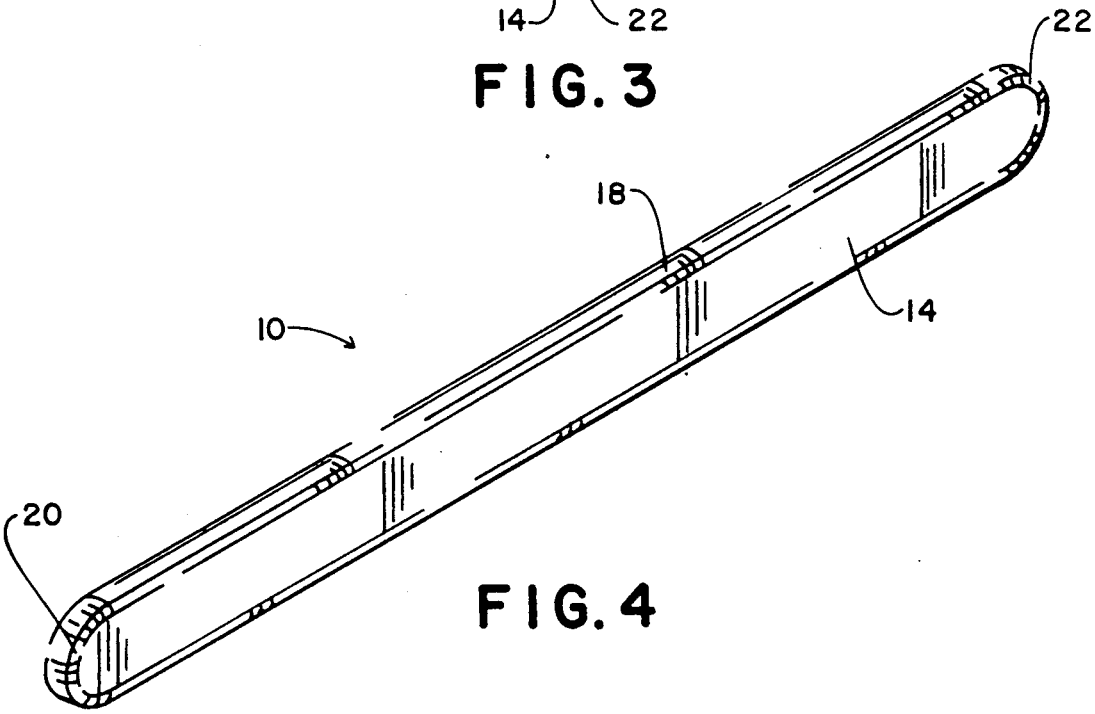
FIG. 4 is a perspective view, on a larger scale, of the drum stick of FIGS. 1–3.

As illustrated in FIG. 2, drum stick 10 has, from one end to the other, an essentially uniform thickness, as defined by the distance between planar surfaces 12 and 14. Each planar surface 12 and 14 extends essentially the entire length of stick 10, i.e., from one end of the stick to the other.

As illustrated in FIGS. 5–9, another drum stick 30 comprises an integral body defined by a pair of elongate tapered planar surfaces 32 and 34. Surfaces 32 and 34 are joined to one another by a pair of rounded sides or edges 36 and 38 which are mutually angled and extend in a generally longitudinal direction. Each planar surface 32 and 34 is bounded at a proximal or handle end portion 40 by a generally straight or transverse edge 42, which is slightly rounded (see FIG. 9). At a distal end, drum stick 30 terminates in a drum striking or drum contact portion 44 which is formed at the free end with a generally semicircular arc 46 rounded to join planar surfaces 32 and 34 to one another.

Figure 5:
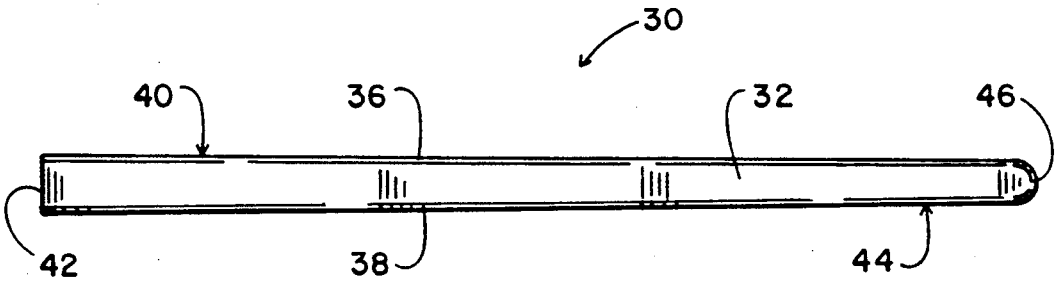
FIG. 5 is a top plan view, on a reduced scale, of another drum stick in accordance with the present invention.
Figure 6:
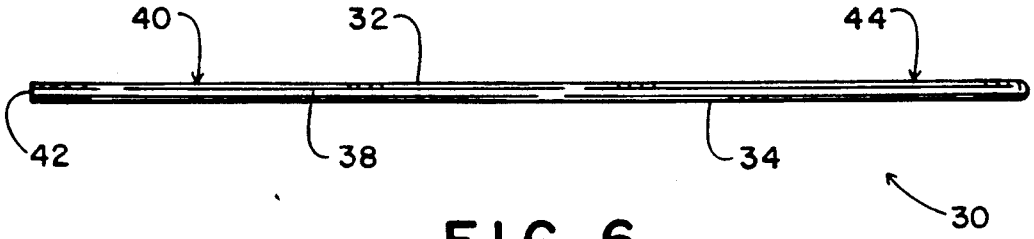
FIG. 6 is a side elevational view, on the scale of FIG. 5, of the drum stick of FIG. 5.
Figure 7:
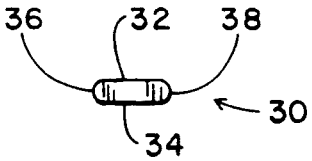
FIG. 7 is a rear elevational view, essentially on the scale of FIGS. 5 and 6, of the drum stick of those drawing figures.
Figure 8:
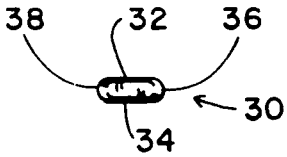
FIG. 8 is a rear elevational view, essentially on the scale of FIGS. 5–7, of the drum stick of those drawing figures.
Figure 9:
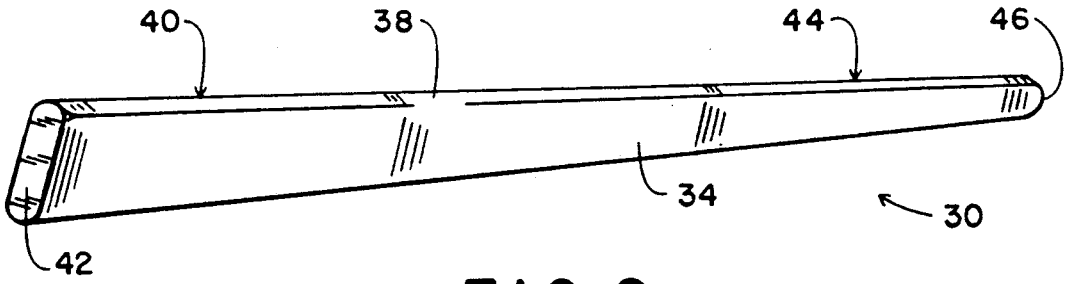
FIG. 9 is a perspective view, on a slightly larger scale, of the drum stick of FIGS. 5–8.

As illustrated in FIG. 6, drum stick 30 has, from one end to the other, an essentially uniform thickness, as defined by the distance between planar surfaces 32 and 34. Each planar surface 32 and 34 extends essentially the entire length of stick 30, i.e., from one end of the stick to the other. As shown in FIG. 5, each planar surface 32 and 34, and concomitantly drum stick 30, has a width which is tapered from one end of stick 30 to the other.

Figure 10:
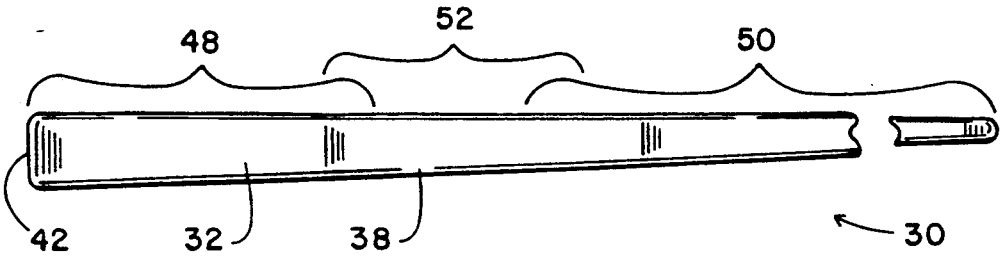
FIG. 10 is a top elevation view of the drum stick of FIGS. 5–8, on a larger scale, with exagerration to show variation in a tapering of the drum stick.
Figure 11:
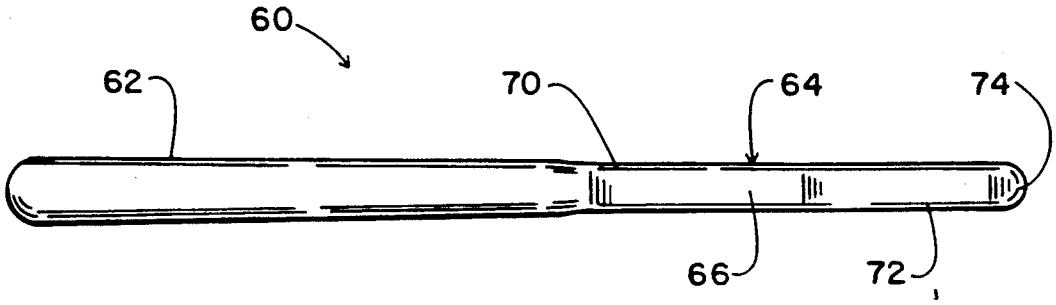
FIG. 11 is a top plan view, on a reduced scale, of yet another drum stick in accordance with the present invention.
Figure 12:
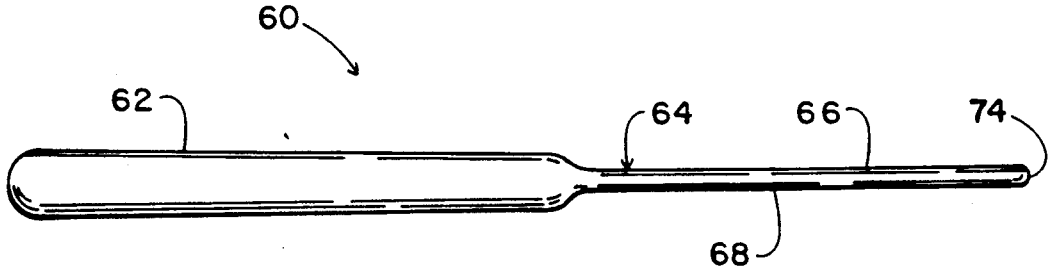
FIG. 12 is a side elevational view, on the scale of FIG. 12, of the drum stick of that drawing figure.
Figure 13:
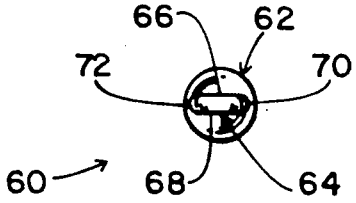
FIG. 13 is a front elevational view, essentially on the scale of FIGS. 11 and 12, of the drum stick of those drawing figures.
Figure 14:
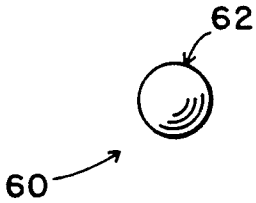
FIG. 14 is a front elevational view, essentially on the scale of FIGS. 11–13, of the drum stick of those drawing figures.
Figure 15:
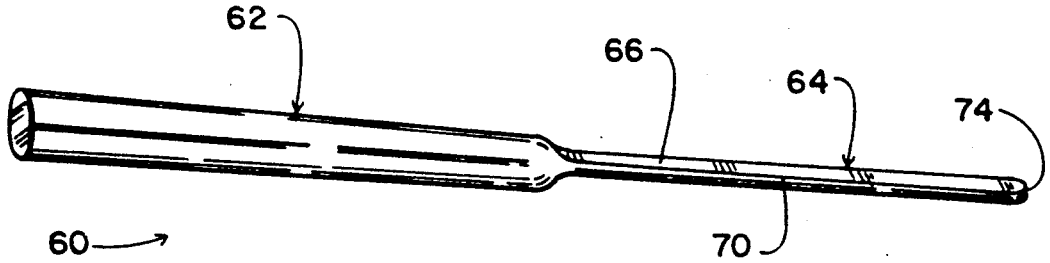
FIG. 15 is a perspective view, on a slightly larger scale, of the drum stick of FIGS. 11–14.

As illustrated in FIG. 10, planar surfaces 32 and 34 may have a first tapered region 48 and a second tapered region 50 at the proximal and distal ends of the drum stick, respectively, the taper of the second region being greater than the taper of the first region, whereby a broadened middle area 52 is formed.

As illustrated in FIGS. 11–15, yet another drum stick 60 comprises an integral body having a generally cylindrical, slightly tapered handle portion 62 at a proximal end of the drum stick and a planar drum contact portion 64 at a distal end of the instrument: Drum contact portion 64 of drum stick 60 is defined by a pair of elongate tapered planar surfaces 66 and 68. Surfaces 66 and 68 are joined to one another by a pair of rounded sides or edges 70 and 72 which are mutually angled (but not necessarily so) and extend in a generally longitudinal direction. Each planar surface 66 and 68 is connected at a proximal end to handle portion 62. At a distal end, each planar surface 66 and 68 is bounded by a semicircular arc 74 which is rounded to join planar surfaces 66 and 68.

Drum sticks 10, 30 and 60 may be made of virtually any material such as polymeric substances or fiberglass. However, hard wood is recommended for its strength, lightness and resonant characteristics. Utilizable woods can be divided into three categories of hardness and density: soft, medium and hard. Harder and denser woods are used for a strong attack. Medium density wood will produce a lesser, brighter response (less volume than the heavier woods). Soft wood will produce more bass response in the range of notes. Hard woods include morado, ebony, hickory, and bubinga, while medium woods include walnut, cherry, mahogany, and zebra. Soft woods include pine, poplar, and big leaf maple. It is to be noted that grain orientation and moisture content should be controlled to provide a drum stick with desirable percussive characteristics.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proferred by way of example to facilitate comprehension of the invention and should not be construed to limit the scope thereof.

What is claimed is:

1. A drum stick comprising:

a handle portion; and a drum contact portion connected to said handle portion, said handle portion and said drum contact portion having a planar surface extending from one end of the drum stick to an opposite end thereof.

2. The drum stick defined in claim 1 wherein said handle portion and said drum contact portion are planar and continuous with one another.

3. The drum stick defined in claim 2 wherein said drum contact portion has a substantially semicircular distal end.

4. The drum stick defined in claim 3 wherein said distal end has a rounded edge.

5. The drum stick defined in claim 2 wherein said drum contact portion is integral with said handle portion.

6. The drum stick defined in claim 2 wherein said drum contact portion has rounded longitudinally extending edges.

7. The drum stick defined in claim 2 wherein said drum contact portion is tapered from said handle portion towards a distal end of the drum stick.

8. The drum stick defined in claim 1 wherein said drum contact portion has a substantially semicircular distal end.

9. The drum stick defined in claim 8 wherein said distal end has a rounded edge.

10. The drum stick defined in claim 1 wherein said drum contact portion is integral with said handle portion.

11. The drum stick defined in claim 1 wherein said drum contact .portion has longitudinally extending rounded edges.

12. The drum stick defined in claim 1 wherein said drum contact portion is tapered from said handle portion towards a distal end of said drum stick.

13. A drum stick comprising an elongate unitary member having an essentially uniform thickness from one end to an opposite end, said stick having a planar surface extending from said one end to said opposite end.

14. The drum stick defined in claim 13 wherein said planar surface is one of a pair of opposed planar surfaces each extending from said one end to said opposite end.

15. The drum stick defined in claim 14 wherein said stick has rounded longitudinally extending edges each extending from said one end to said opposite end.

16. The drum stick defined in claim 14 wherein said stick has a width which is tapered from said one end to said opposite end.

17. A drum stick comprising an elongate unitary member having a planar surface extending essentially from one end of the drum stick to an opposite end thereof.

18. The drum stick defined in claim 17 wherein said planar surface is one of a pair of opposed planar surfaces each extending from said one end to said opposite end.

19. The drum stick defined in claim 18 wherein said stick has rounded longitudinally extending edges each extending from said one end to said opposite end.

20. The drum stick defined in claim 18 wherein said stick has a width which is tapered from said one end to said opposite end.

* * * * *